United States Patent [19]

Archer

[11] Patent Number: 4,648,678

[45] Date of Patent: Mar. 10, 1987

[54] ELECTRICAL CONNECTOR

[75] Inventor: Lee A. Archer, Ashville, N.C.

[73] Assignee: Brand-Rex Company, Willimantic, Conn.

[21] Appl. No.: 750,903

[22] Filed: Jul. 1, 1985

[51] Int. Cl.[4] ..... H01R 4/24

[52] U.S. Cl. ..... 339/99 R

[58] Field of Search ..... 339/97 R, 97 P, 98, 339/99 R, 91 R

[56] References Cited

U.S. PATENT DOCUMENTS

| | | | |
|---|---|---|---|
| 3,895,852 | 7/1975 | Wasserlein, Jr. | 339/99 R |
| 4,040,705 | 8/1977 | Huber | 339/99 R |
| 4,333,700 | 6/1982 | Pugh, III | 339/97 R |
| 4,425,019 | 1/1984 | Pohl | 339/97 R |
| 4,508,410 | 4/1985 | Canham | 339/99 R |
| 4,545,635 | 10/1985 | Bunnell | 339/99 R |

*Primary Examiner*—Joseph H. McGlynn
*Attorney, Agent, or Firm*—McCormick, Paulding & Huber

[57] ABSTRACT

A wall plug jack has a housing which defines a plug receiving cavity and contains a circuit board assembly which includes a row of cantilever spring contacts electrically connected to separate circuits imprinted on the circuit board. Each spring contact has a pair of legs connected together by an integral reversely bent arcuate connecting portion which subtends an arc of at least 180 degrees between distinct integral junctions formed with the legs. One of the legs has a free end and is at least partially disposed within the cavity. A row of insulation displacement terminals equal in number to the spring contacts are supported on the housing and electrically connected to the spring contacts by circuits imprinted on the circuit board. Each terminal has a generally L-shaped configuration defined by a mounting portion and a pair of spaced apart fingers which extend from said mounting portion and define a slot therebetween. The walls of the slot converge toward an opening at the free end of the terminal. The L-shaped fingers function as torsion bars and twist in opposite directions when a conductor is forceably inserted into the slot therebetween.

12 Claims, 4 Drawing Figures

ELECTRICAL CONNECTOR

BACKGROUND OF THE INVENTION

This invention relates in general to electrical connectors and deals more particularly with an improved female connector or jack particularly adapted to receive a complimentary portion of a modular plug connector of FCC approved type. Such approved plugs are standardized by FCC regulation to assure mating engagement with associated jacks of approved type. However, FCC regulations allow some leeway in plug construction. Consequently, a nominal 6 pole plug for terminating a cable containing three pair of conductors will fit an eight pole jack, that is a jack particularly adapted to receive a nominal eight pole plug for terminating a cable containing four pair of conductors. Such plugs are usually provided with a row of fixed contacts as, for example, spade contacts, disposed within a row of contact receiving slots formed in the plugging end of the plug housing. Each fixed contact on such a plug is adapted to engage and deflect an associated spring contacts contained within a plug receiving cavity in jack housing.

Portions of the plug housing at laterally opposite ends of the row of plug receiving slots comprise solid plastic material, that is material free of slots. This arrangement presents no problem when the jack into which the plug is inserted contains the same number of contact as the plug or a lesser number of contacts. However, if a plug is inserted into a receptacle or jack having a larger number of spring contacts than the number of contacts carried by the plug, the outboard spring contacts, that is the spring contacts within the jack at opposite ends of the row, will be engaged by the solid material at laterally opposite ends of the plug housing and deflected a considerably greater amount than the other spring contacts therebetween which engage associated fixed contacts on the plug in a conventional manner. Such excessive deflection caused by insertion of a mismated plug often results in the outboard spring contacts taking a permanent set, as for example, when a plug having three pairs of fixed contacts is inserted into a jack having four sets of spring contacts. When a proper plug is thereafter inserted into the jack the "set" spring contacts within the jack may establish poor electrical contact with associated fixed contacts on the plug or entirely fail to function.

When a jack of the aforedescribed type is to be used for field termination it may be provided with terminals of insulation displacement type. However, such terminals as are presently available are suitable for terminating conductors in only a relatively narrow range of gauges. An increase in the range of gauges for which a terminal of a given size may be used is usually accompanied by an increase in the tendency of the terminal to become overstressed or take a set when used to terminate conductors at the larger end of the range.

Accordingly, it is the general aim of the present invention to provide an improved modular jack for receiving approved FCC modular plugs having varying numbers of fixed contacts without risk of damage to the jack. A further general aim of the invention is to provide an improved insulation displacement terminal for use on electrical connectors and the like.

SUMMARY OF THE INVENTION

In accordance with the invention an electrical connector comprises a dielectric housing defining a forwardly opening plug receiving cavity. A transversely spaced apart series of substantially identical resilient spring contacts are disposed within the housing. Each contact has a pair of elongated legs and an integral reverse bend arcuate connecting portion joining the forward ends of the legs. One of the legs has a rear end portion secured in fixed position relative to the housing and extends in the direction of the forward end terminating at a distinct junction with the arcuate connecting portion. The other of the legs has a forward end portion forming a second distinct junction with the other end of the arcuate connecting portion and being downwardly inclined from the second junction in the direction of the rear end of the housing and terminating a free end. At least a portion of the other leg is disposed within the plug receiving cavity. The arcuate connecting portion which joins the legs subtends an arc of at least 180 degrees between the first and second junctions. A means is provided for connecting an associated electrical conductor to each of the resilient contacts. Further, and in accordance with another aspect of the invention, the connecting means comprises a plurality of bifurcated insulation displacement terminals mounted in fixed position relative to the housing and in spaced apart relation to each other. Each terminal has a mounting base portion and a pair of elongated transversely spaced apart fingers which extend form the mounting portion and terminate at a free end of the terminal. The fingers have opposing inwardly facing side walls which converge toward the free end of the terminal and define a slot therebetween which opens through the free end. Each of the fingers has a first portion connected to the mounting base portion and extending therefrom, an arcuate connecting portion integrally joined at one end to the outer end of the first portion and curving outwardly and away from the first portion, and a second portion integrally joined to the other end of the arcuately curved portion, extending away from it and terminating at the free end of the terminal.

DETAILED DESCRIPTION OF PREFERRED EMBODIMENT

Figure 2:
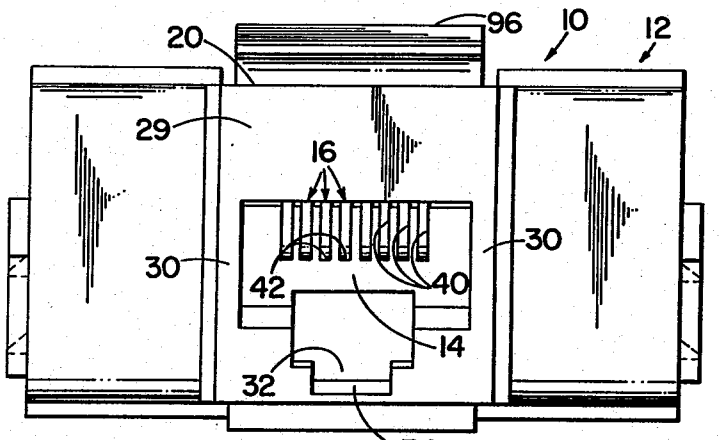
FIG. 2 is a front elevational view of the wall plate jack.

Turning now to the drawings and referring first particularly to FIGS. 1–5, a wall plate jack embodying the present invention is indicated generally by the reference numeral 10. The illustrated jack 10 essentially comprises a housing assembly indicated generally at 12 and has a plug receiving cavity 14, shown in FIGS. 2 and 4, opening through its forward end and shaped to receive and compliment an associated FCC approved electrical connector or plug (not shown). A row of cantilever spring contacts designated generally by the numeral 16, 16 are supported within the housing 12. Each contact 16 has a free end portion, at least a part of which is exposed within the cavity 14 for engaging an associated electrical contact mounted in fixed position on a mating plug when the plug is inserted into the housing as will be hereinafter more fully discussed. The jack 10 further includes a plurality of electrical terminals indicated generally at 18, 18, exposed externally of the housing and equal in number to the spring contacts 16, 16. Each terminal 18 is electrically connected to an associated spring contact 16. The number of spring contacts in the jack may vary, however, the illustrated jack 10 is particularly adapted for mating engagement with an FCC approved modular plug for terminating four pair electrical conductors and has eight resilient spring contacts 16, 16. The illustrated jack 10 also includes a snap-on conductor stuffer indicated generally at 100. In accordance with the invention the spring contacts 16, 16 are constructed and supported within the housing assembly 12 to resist damage resulting from plugging of an improper plug models into the jack 10. Further, and in accordance with the invention, the improved insulation displacement terminals 18, 18 assure gas-tight junctions with the various conductors.

Considering now the jack 10 in further detail, the housing assembly 12 is preferably molded from dielectric plastic material and includes a hollow housing 20, a contact seat 22, received within the housing, and a rear wall structure 24 which provides a closure of the rear end of the housing. The housing 20 comprises a relatively thin walled shell and has a generally rectangular front end portion which defines the plug receiving cavity 14. The housing further includes a top wall 26, a bottom wall 28, a front wall 29 and a pair of opposing side walls 30, 30. A central recess 32 is formed in the bottom wall 28 to receive a portion of a modular plug and its latching tab (not shown). A stationary latch engaging member projects above the bottom wall 28 within the central recess 32 and defines a cam surface 34 and a rearwardly facing abutment surface 36, best shown in FIG. 4. The cam surface 34 is positioned to deflect a resilient latch tab on an associated modular plug as the plug is inserted into the housing. The abutment surface 36 is arranged for snap engagement with an associated forwardly facing latching surface on the resilient latch tab to releasably retain the plug in assembly with the housing 20, in a manner well known in the connector art. Another fixed latch member 37 depends from the bottom wall 28 for a purpose to be hereinafter explained.

The housing assembly further includes an integral verticaly disposed and transversely extending partition wall 38 which defines the rear wall of the cavity 14. A transversely spaced apart row of upwardly extending contacts alignment slots 40, 40 are formed in the partition wall 38 equal in number to the number of spring contacts 18, 18 supported within the housing. Since the illustrated connector 10 has eight spring contacts, eight contact alignment slots 40, 40 are provided. The lower end wall of each slot defines an upwardly facing abutment surface 42 for a purpose which will be hereinafter evident.

Figure 7:
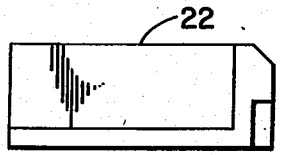
FIG. 7 is a side elevational view of the contact seat insert.
Figure 8:
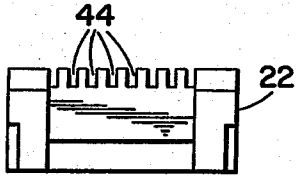
FIG. 8 is a right end view of the contact insert as oriented in FIG. 7.
Figure 6:
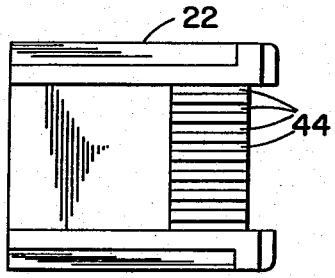
FIG. 6 is a plan view of the contract seat insert.
Figure 5:
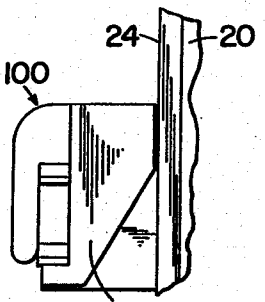
FIG. 5 is a fragmentary side elevational view of the wall plate jack.

The contact seat 22, best shown in FIGS. 6–8 comprises is an insert received within the forward portion of the housing immediately above the partition wall 38 and extending transversly of the housing 20. A central portion of the contact seat has a plurality of upwardly open contact alignment slots 44, 44 (eight in the illustrated embodiment). Each slot 44 is vertically aligned with an associated contact alignment slot 40.

Figure 9:
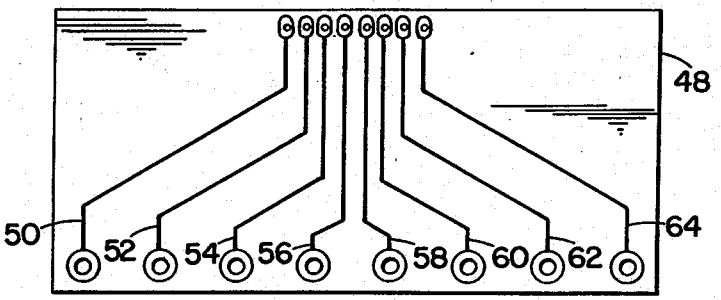
FIG. 9 is a front elevational view of the printed circuit board.

Preferably, and as shown, the resilient spring contacts 16, 16 and the terminals 18, 18 comprise part of a circuit board assembly, indicated generally at 46 (FIG. 4), which includes a generally rectangular printed circuit board 48 upon which the spring contacts 16, 16 and the terminals 18, 18 are mounted. The circuit board 48, best shown in FIG. 9, is supported within the rear portion of the housing 20 and has a plurality of individual printed circuits 50–64 imprinted thereon and equal in number to the number of spring contacts 16, 16. Each printed circuit electrically connects one of the spring contacts 16, 16 to an associated one of the terminals 18, 18.

Figure 4:
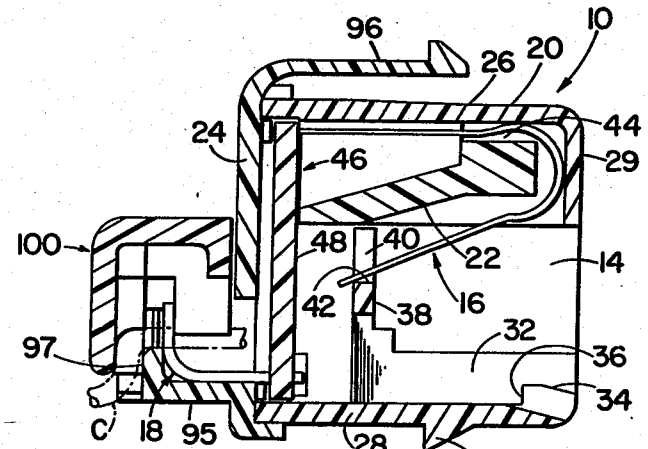
FIG. 4 is a sectional view taken generally along the line 4—4 of FIG. 3.
Figure 10:
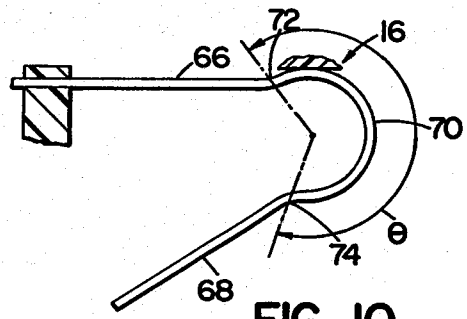
FIG. 10 is a somewhat enlarged side elevational view of a typical cantilever spring contact.

The spring contact 16, 16 are preferably formed from flat spring metal and have a generally hair pin-like shape. A typical spring contact 16, shown in FIG. 10, has a pair of elongated legs 66 and 68 and an intregal arcuate reverse bend connecting portion 70 joined to the foward end portions of the legs 66 and 68 at distinct junctions indicated at 72 and 74. The upper leg 66 is connected in fixed position at its rear end to the circuit board 48 and to an associated circuit imprinted thereon and extends in a forward direction through the upper part of the housing 20 in downwardly spaced relation to the top wall 26. The arcuate connecting portion 70 is preferably parti-circular, bears against the top wall 26 near the junction 72, as shown in FIGS. 4 and 10, and subtends an arc of at least 180 degrees between the junctions 72 and 74 to partially encircle the forward edge of the contact seat 22, substantially as shown in FIG. 4. The arcuate connecting portion has an unsupported parti-circular inner surface spaced from the housing. Preferably, the arcuate portion in its undeflected condition subtends an optimum arc of approximately 205 degrees, as indicated at $\theta$ in FIG. 10. The lower leg 68 is inclined downwardly and rearwardly from the junction 74 terminates at a free end portion disposed within an associated contact alignment slot 40, and bears against an associated abutment surface 42 which forms the bottom wall of the slot. The lower leg 68 is held in an upwardly deflected condition by its associated abutment surface 42. This arrangement preloads the spring contact 16. The leg 68, which is at least partially disposed within the cavity 14, will be further deflected by insertion of a modular plug connector into the plug receiving cavity 14. The contact alignment slots 40, 40 cooperate with the contact alignment slots 44, 44 to maintain the spring contacts 16, 16 in parallel alignment and transversely spaced apart relation to each other whereby the contacts 16, 16 form a row extending transversely of the housing 20.

Figure 1:
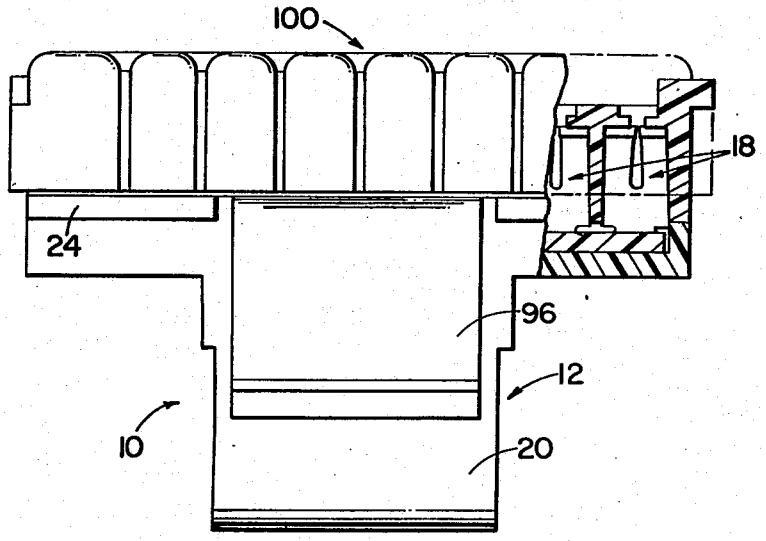
FIG. 1 is a plan view of a wall plate jack embodying the present invention and shown with a portion of its housing and conductor stuffer broken away to reveal structure therebetween.

The rear portion of the housing 20 is substantially wider than the forward portion, as shown in FIGS. 1 and 2, to accommodate the terminal 18, 18 which are of substantially greater width than the spring contacts 16, 16. It is for this reason that the circuits 50–64 are imprinted on the circuit board in a fan shaped pattern, as shown in FIG. 9. Each terminal 18 is mounted on the circuit board 48 in electrically connecting engagement with an associated one of the circuits 50–64. The terminals 18, 18 are arranged in spaced relation to each other in a row extending transversely of the housing and project from the rear surface of the circuit board 48, as best shown in FIG. 4.

Figure 11:
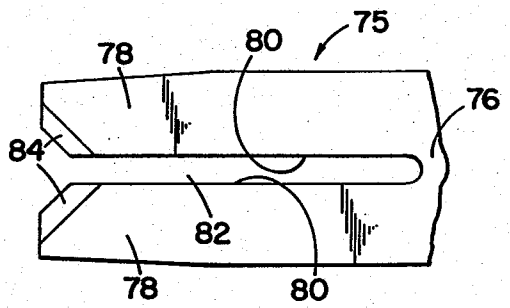
FIG. 11 is a fragmentary plan view of a blank from which a typical terminal is formed.

Considering now the insulation displacement terminals in further detail and referring particulary to FIGS. 11–15 a typical terminal 18 is formed from a resilient elastic material such a flat metal strip or blank indicated generally at 75 and shown in FIG. 11. The terminal 18 has a mounting base portion indicated by the numeral 76 and a pair of elongated transversely spaced apart fingers 78, 78 of substantially uniform cross section which extend from the mounting base portion and terminate at free ends. The fingers having opposing inwardly facing side walls 80, 80 which define an elongated slot 82 opening through the free ends of the terminal. The free end portion of the finger 78, 78 have relatively sharp edges 84, 84 which define an outwardly diverging free end portion of the slot 82.

Figure 14:
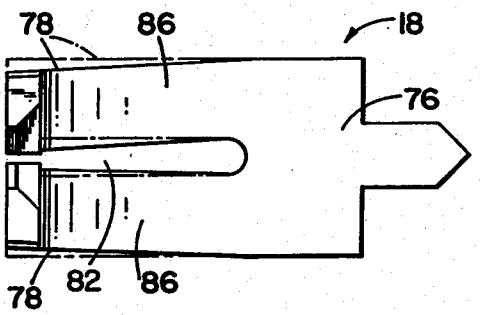
FIG. 14 is a plan view of the terminal of FIG. 12.
Figure 13:
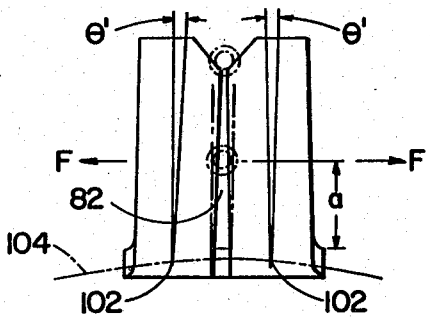
FIG. 13 is a left end view of the terminal shown in FIG. 12.
Figure 12:
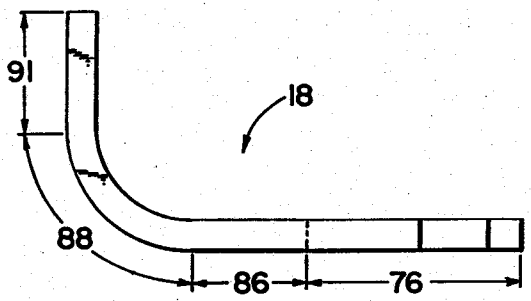
FIG. 12 is a somewhat enlarged side elevational view of a typical terminal.

The blank 75 is preferably bent generally to the form shown in FIG. 12. After bending, each finger 78 has a first portion 86 connected to the mounting portion 76 and extending outwardly from it, an arcuate connecting portion 88 integrally joined at one end to the outer end of the first portion 86 and curving outwardly and away from first portion, and a second portion 91 integrally joined to the outer end of the connecting portion 88 and extending away from the connecting portion and terminating at the free end of the terminal, as best shown in the side elevational view of the terminal 18 (FIG. 12). The arcuately curved connecting portion preferably comprises a 90 degree radial bend so that the second portion 91 extends in a direction generally normal to the direction of extent of the first portion 86. The fingers are also bent inwardly toward each other, as shown in FIG. 14, and are preferably bent at a point at or near the junction between the first portions 86, 86 and the mounting base portion 76. In FIG. 14 the fingers 78, 78 are shown in broken lines as they appear before being bent inwardly and in full lines after having been bent inwardly toward each other. Referring now to FIGS. 13 and 14 it will be noted that the slot side walls 80, 80 converge toward the free ends of the terminal 18.

Figure 3:
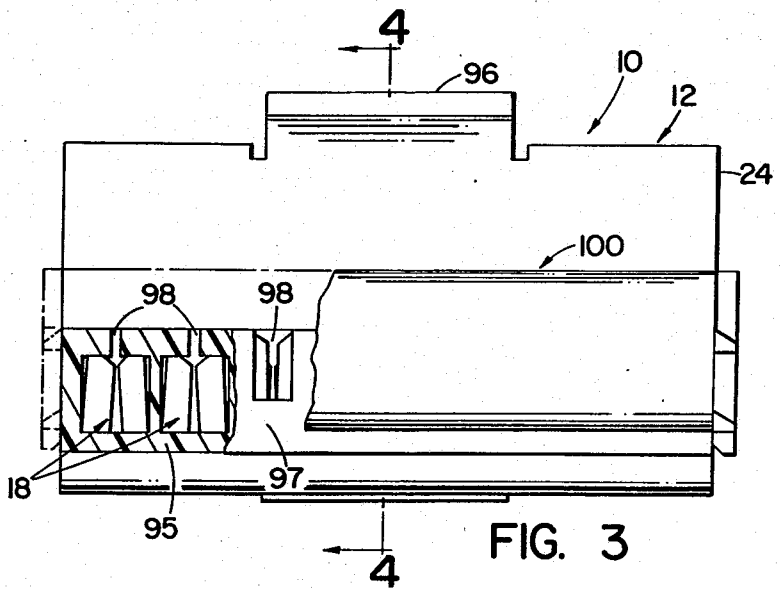
FIG. 3 is a rear elevational view of the jack shown with portions of the conductor stuffer and housing broken away to reveal structure therebehind.

The rear wall structure 24 provides a closure for the rear of the housing 20 and also carries a resilient latch tab 96 which cooperates with the fixed latch member 37 to releasably retain the wall plate jack 10 in assembly with an associated apertured wall plate (not shown). The rear wall structure also includes a bottom wall 95 and a back wall 97 which cooperate to define a supporting enclosure for the row of terminals 18, 18. Entry slots 98, 98 formed in the back wall 97, as shown in FIG. 3, facilitate access to the insulation displacement terminals 18, 18 externally of the housing.

As previously noted the wall jack 10 is particularly adapted to terminate a cable containing four pair of conductors. A portion of the outer jacket of the cable is first removed to expose individually insulated solid wire electrical conductors contained within the cable jacket and which usually color coded. Corresponding color codes (not shown) are preferably provided on the rear wall structure 24 above the various entry slots 98, 98 to assure proper conductor termination. After the individual insulated conductors have been separated, an insulated end portion of each conductor is inserted into an associated entry slot 98 of proper color code and pulled downwardly into the slot 82 of an insulation displacement terminal 18 associated with the entry slot. The sharpened diverging free end portions 84, 84 which define the free end of each terminal slot 82 effect initial displacement of the insulation on the conductor and also serve to guide it into the terminal slot 82. An upwardly facing abutment at the lower end of each entry slot 98 serves as a stop to assure proper positioning of each conductor within an associated insulation displacement terminal 18.

Figure 15:
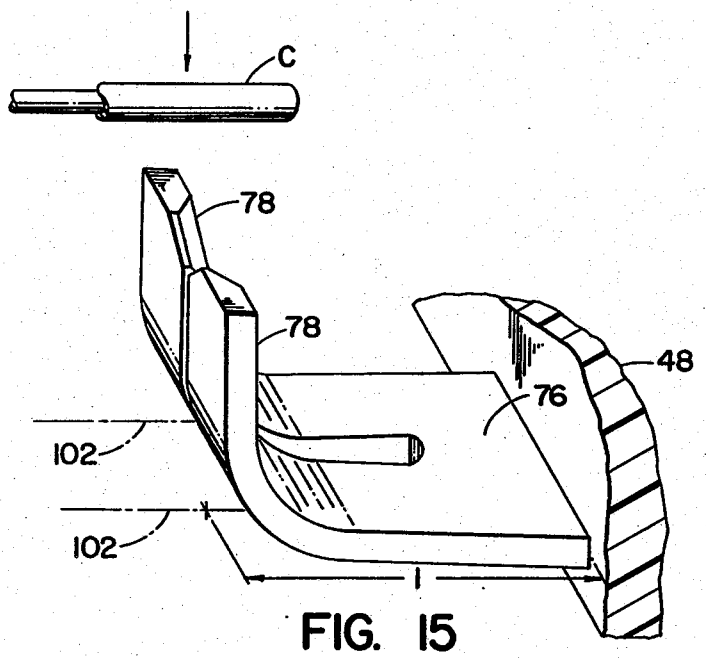
FIG. 15 is a fragmentary perspective view of a typical terminal assembly and illustrates the torsional stresses developed in the terminal when a conductor is forceably inserted into it.

Due to the uniquely bent arrangement of the terminals 18, 18, the fingers 78, 78 of each terminal function as torsion bars or springs. Referring now to FIGS. 13 and 15, as an insulated conductor C is forced into an associated terminal slot 82 the insulation on the conductor first encounters the sharp edges 84, 84 which cut through the insulation and displace it. As the conductor enters the slot 82 force is applied to the fingers 78, 78 which define the slot causing the fingers to twist in opposite directions about axes indicated at 102, 102. Thus the applied torque F acting through the radial distance (a) produces an angle of twist $\theta'$. Each torsion bar or finger 78 is helically twisted throughout its effective length (1) thereby producing opposing torque which causes the conductor C to be tightly engaged by and between the fingers whereby a substantially gas tight seal is attained. Forceably insertion of the conductor C into the slot 82 also tends to produce a slight transverse bending moment in the mounting base portion 76, the latter bending action being illustrated with reference to the axis of the mounting base portion indicated by the numeral 104 in FIG. 13. The reactant force produced within the system and which act upon the conductor will, of course, be determined by the physical dimensions of the terminal and the material from which it is made.

The construction and arrangement of a terminal as hereinbefore described enables it to absorb a relatively great load before reaching a yield point at the points of connection between its fingers and its mounting base portion. Further, terminals constructed in the aforedescribed manner will exert substantially uniform spring force upon conductors though a relatively wide range of conductor gauges may be terminated. It has been found that the aforedescribed terminals provides superior conductor retention even after being used repeatedly to termination conductors in a wide range of gauges.

The conductor stuffer 100 firmly seats each conductor in its associated terminal slot. Resilient locking tabs 106, 106 at opposite ends of the conductor stuffer 100 engage associated locking tabs on opposite sides of the housing to releasably retain the conductor stuffer in assembled position on the housing.

The deflected or pre-loaded legs 68, 68 of the spring contacts 16, 16 assure gas-tight junctions of high integrity between the resilient contacts of the jack and the fixed contacts of an associated plug inserted therein. In the event that an improper or mismated plug is inserted into the plug receiving cavity 14, as for example, if a nominal 6 pole plug is inserted into a nominal 8 pole jack, such as the jack 10, the outboard spring contacts 18, 18 may be deflected beyond the normal expected range of deflection, however, the relatively large arcuate connecting portions 70, 70 which connect the fixed and free legs of the spring members 16, 16 provide a great degree of flexibility and distribute the bending moment so that the spring members 16, 16 may be bent upwardly to an extreme position without being overstressed or taking a permanent set. It has been found that the spring contacts such as the contacts 16 constructed and arranged in the manner aforedescribed may be subjected to repeated excessive deflection without risk of damage.

I claim:

1. An electrical connector comprising a dielectric housing defining a forwardly opening plug receiving cavity, a transversely spaced apart series of substantially identical resilient unitary cantilever spring contacts supported within said housing, each of said contacts having elongated first and second legs and a parti-circular arcuate reversely bent connecting portion substending an arc of at least 180 degrees and having an unsupported parti-circular inner surface spaced from said housing, said connecting portion having a first end integrally connected to the forward end of said first leg at a first distinct junction and a second end integrally connected to the forward end of said second leg at a second distinct junction, said first leg extending rearwardly from said first distinct junction and having a rear end portion secured in fixed position to said housing, said second leg extending rearwardly and downwardly from said second distinct junction and having a rear end portion free to move relative to said housing, said second leg having at least a portion thereof exposed within said plug receiving cavity, and means for connecting an associated electrical conductor to each of said resilient spring contacts.

2. An electrical connector as set forth in claim 1 wherein a part of said arcuate connecting portion near said first distinct junction is engagable with an associated portion of said housing and said first leg extends rearwardly from said first distinct junction in spaced relation to said housing.

3. An electrical connector as set forth in claim 1 wherein said parti-circular portion subtends an arc greater than 180 degrees between said first and second junctions.

4. An electrical connector as set forth in claim 1 wherein said housing has a contact seat extending transversely of said cavity and having a forward edge portion and said parti-circular portion partially encircles said forward edge portion.

5. An electrical connector as set forth in claim 1 wherein said arcuate connecting portion substends an arc of at least 205 degrees.

6. An electrical connector as set forth in claim 1 including deflecting means within said housing for maintaining by said rear end portion of each of said second leg in a deflected condition.

7. An electrical connector as set forth in claim 6 wherein said deflecting means comprises abutment means on said housing.

8. An electrical connector comprising a housing having a forwardly opening plug receiving cavity, a transversely spaced apart series of cantilever spring contacts disposed within said housing, each of said spring contacts having a pair of legs integrally connected to each other by a reversely bent connecting portion, and end portion of one of said legs being secured in fixed position relative to said housing, the other of said legs having a free end portion, said other leg having at least a portion thereof exposed within said cavity for engaging an associated contact on a plug received in plugging engagement with said housing within said cavity, and a plurality of resilient bifurcated generally L-shaped insulation displacement terminals equal in number to said spring contacts and mounted in fixed position relative to said housing and in spaced apart relation to each other and accessible externally of said housing, each of said terminals having a mounting portion and a pair of elongated transversely spaced apart generally L-shaped fingers extending from said mounting portion and terminating at a free end, said fingers having opposing inwardly facing L-shaped side walls, said L-shaped fingers being inwardly toward each other proximate said mounting portion, said L-shaped side walls converging along the length thereof from said mounting base toward said free end and defining an L-shaped conductor receiving slot therebetween opening through said free end, and means electrically connecting each of said terminals to an associated one of said spring contacts.

9. An electrical connector as set forth in claim 8 wherein said fingers have relatively sharp edges at the free ends thereof defining an outwardly diverging opening at said free end communicating with said slot.

10. A unitary generally L-shaped bifurcated insulation displacement terminal formed from resilient flat metal and comprising a mounting base portion and a pair of elongated transversely space apart generally L-shaped fingers integrally extending from said mounting base portion and terminating at a free end of said terminal, said fingers having opposing inwardly facing L-shaped walls, said fingers being bent inwardly toward each other near said mounting base, said L-shaped side walls converging from said mounting base along the length of said sidewalls toward said free end and defining a generally L-shaped conductor receiving slot terminating at an opening through said free end.

11. An electrical terminal as set forth in claim 10 wherein said fingers have sharp edgg portions at the free ends thereof defining an opening at the free end of said terminal communicating with said slot.

12. A unitary generally L-shaped electrical terminal formed from resilient flat metal and comprising a mounting base portion and a pair of generally L-shaped fingers projecting from said mounting base portion in spaced apart relation to each other, each of said fingers having a first portion integrally connected to said mounting base portion and extending therefrom in the plane of said mounting base portion, a second portion generally normal to said first portion and an arcuate connecting portion integrally joined to said first portion and said second portion and providing connection therebetween, said fingers having opposing generally L-shaped side walls defining a generally L-shaped conductor receiving slot between said fingers, each of said fingers having a substantially uniform cross section throughout the length of said slot, each of said fingers being bent inwardly toward the other of said fingers proximate the connection between its first portion and said base portion, said opposing generally L-shaped sidewalls converging along the entire length thereof from said mounting base portion toward the free ends of said fingers, said fingers having sharpened inner edges at said free ends defining an outwardly diverging opening at the free end of said terminal communicating with said slot.

* * * * *